US011292561B2

(12) United States Patent
Shiue

(10) Patent No.: US 11,292,561 B2
(45) Date of Patent: Apr. 5, 2022

(54) SNORKEL MOUTHPIECE ASSEMBLY

(71) Applicant: QBAS CO., LTD., Taipei (TW)

(72) Inventor: Chih-Cheng Shiue, Taipei (TW)

(73) Assignee: QBAS CO., LTD., Taipei (TW)

( * ) Notice: Subject to any disclaimer, the term of this patent is extended or adjusted under 35 U.S.C. 154(b) by 169 days.

(21) Appl. No.: 16/733,635

(22) Filed: Jan. 3, 2020

(65) Prior Publication Data

US 2021/0031889 A1 Feb. 4, 2021

(30) Foreign Application Priority Data

Jul. 29, 2019 (TW) ..... 108209894

(51) Int. Cl.
*B63C 11/18* (2006.01)
*B63C 11/16* (2006.01)
*B63C 11/12* (2006.01)

(52) U.S. Cl.
CPC ..... *B63C 11/186* (2013.01); *B63C 11/16* (2013.01); *B63C 2011/121* (2013.01); *B63C 2011/123* (2013.01)

(58) Field of Classification Search
CPC ..... B63C 11/00; B63C 11/02; B63C 11/12; B63C 11/16; B63C 11/18; B63C 11/186; B63C 11/20; B63C 11/205; B63C 11/207; B63C 11/48; B63C 11/52; B63C 2011/022; B63C 2011/121; B63C 2011/123; B63C 2011/126; B63C 2011/128; B63C 2011/165; Y10T 24/45796; F16B 21/09; F16B 12/22
See application file for complete search history.

(56) References Cited

U.S. PATENT DOCUMENTS 4,907,582 A * 3/1990 Meyerrose ..... B63C 11/205 128/201.11
5,199,422 A * 4/1993 Rasocha ..... B63C 11/205 128/201.11
5,622,422 A * 4/1997 Rodgers ..... F21V 23/04 362/158
6,745,762 B1 * 6/2004 Shiue ..... B63C 11/205 128/201.11
2005/0047122 A1 * 3/2005 Kuo ..... B63C 11/205 362/158
2007/0272237 A1 * 11/2007 Shiue ..... B63C 11/205 128/201.11
2010/0269822 A1 * 10/2010 Shiue ..... B63C 11/205 128/202.27
2012/0247459 A1 * 10/2012 Shiue ..... B63C 11/186 128/201.11

* cited by examiner

*Primary Examiner* — Colin W Stuart
(74) *Attorney, Agent, or Firm* — Muncy, Geissler, Olds & Lowe, P.C.

(57) ABSTRACT

A snorkel mouthpiece assembly, including a main body, a mouthpiece, a connecting component and an accessory, is provided. The mouthpiece is connected to the main body. The connecting component includes a connecting portion and a fixing portion opposite to the connecting portion. The connecting portion is detachably connected to the main body, and the accessory is connected to the fixing portion. In this way, the snorkel mouthpiece assembly could be equipped with a variety of accessories during water or diving activities.

11 Claims, 6 Drawing Sheets

SNORKEL MOUTHPIECE ASSEMBLY

CROSS-REFERENCES TO RELATED APPLICATIONS

The present invention claims priority under 35 U.S.C. § 119 to Taiwan Patent Application No. 108209894 filed on Jul. 29, 2019, the entire contents of which are incorporated herein by reference.

BACKGROUND OF THE INVENTION

Field of the Invention

The present invention provides a snorkel mouthpiece assembly. In particular, it provides a snorkel mouthpiece assembly used in snorkeling or underwater activities.

Descriptions of the Related Art

During snorkeling or underwater activities, people often bring different accessories into the water, e.g., video cameras for photographing aquatic organisms, flashlights for clearly observing organisms or lighting or the like. However, a user must hold these accessories with one or both hands, which inevitably affects his/her paddling or communication using the hand. The user may also risk dropping the accessory into the underwater.

SUMMARY OF THE INVENTION

An objective of the present invention is to provide a snorkel mouthpiece assembly to which various accessories can be easily attached and replaced.

To achieve the aforesaid objective, the snorkel mouthpiece assembly of the present invention comprises a main body, a mouthpiece, a connecting component and an accessory. The mouthpiece is connected to the main body. The connecting component comprises a connecting portion and a fixing portion opposite to the connecting portion. The connecting portion is detachably connected to the main body. The accessory is connected to or assembled to the fixing portion.

In the embodiment, the connecting portion of the snorkel mouthpiece assembly of the present invention is rotatably attached to the main body and is able to rotate from the first position to the second position.

In the embodiment, the fixing portion of the snorkel mouthpiece assembly of the present invention comprises a plurality of ribs for connecting to the accessory. The ribs extend outwards from the outer surface of the connecting portion. An angle is included between the extending direction and the outer surface. The angle is not less than 30 degrees and not greater than 90 degrees.

In the embodiment, the fixing portion of the snorkel mouthpiece assembly of the present invention further comprises a clip component clipping the accessory.

In the embodiment, the main body of the snorkel mouthpiece assembly of the present invention further comprises a first bump and a second bump disposed on the outer edge surface of the main body. The connecting portion further comprises a first sliding slot and a second sliding slot. The first bump is slidably and detachably connected to the first sliding slot. The second bump is rotatably and slidably connected to the second sliding slot; wherein the first sliding slot comprises a first portion and a second portion which are connected. An extending direction of the first portion is interleaved with an extending direction of the second portion. The extending direction of the first portion is substantially parallel to the extending direction of the second sliding slot.

In the embodiment, when the connecting component of the snorkel mouthpiece assembly of the present invention is in the first position, the first bump is in the first portion of the first sliding slot and the second bump is in the second sliding slot. When the connecting component is rotated from the first position to the second position, the first bump is slid from the first portion to the second portion, and then leaves the second portion.

In the embodiment, the second sliding slot of the snorkel mouthpiece assembly of the present invention comprises an opening and a passage which are connected. The opening is closer to the first sliding slot, and the diameter of the opening is larger than the width of the passage.

In the embodiment, the connecting component of the snorkel mouthpiece assembly of the present invention is able to slide from the second position to the third position so that it can leave the main body. When the connecting component is in the third position, the first bump is away from the connecting component and the second bump is in the opening.

In the embodiment, the accessory of the snorkel mouthpiece assembly of the present invention comprises a photographing device or a light emitting device.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1A:
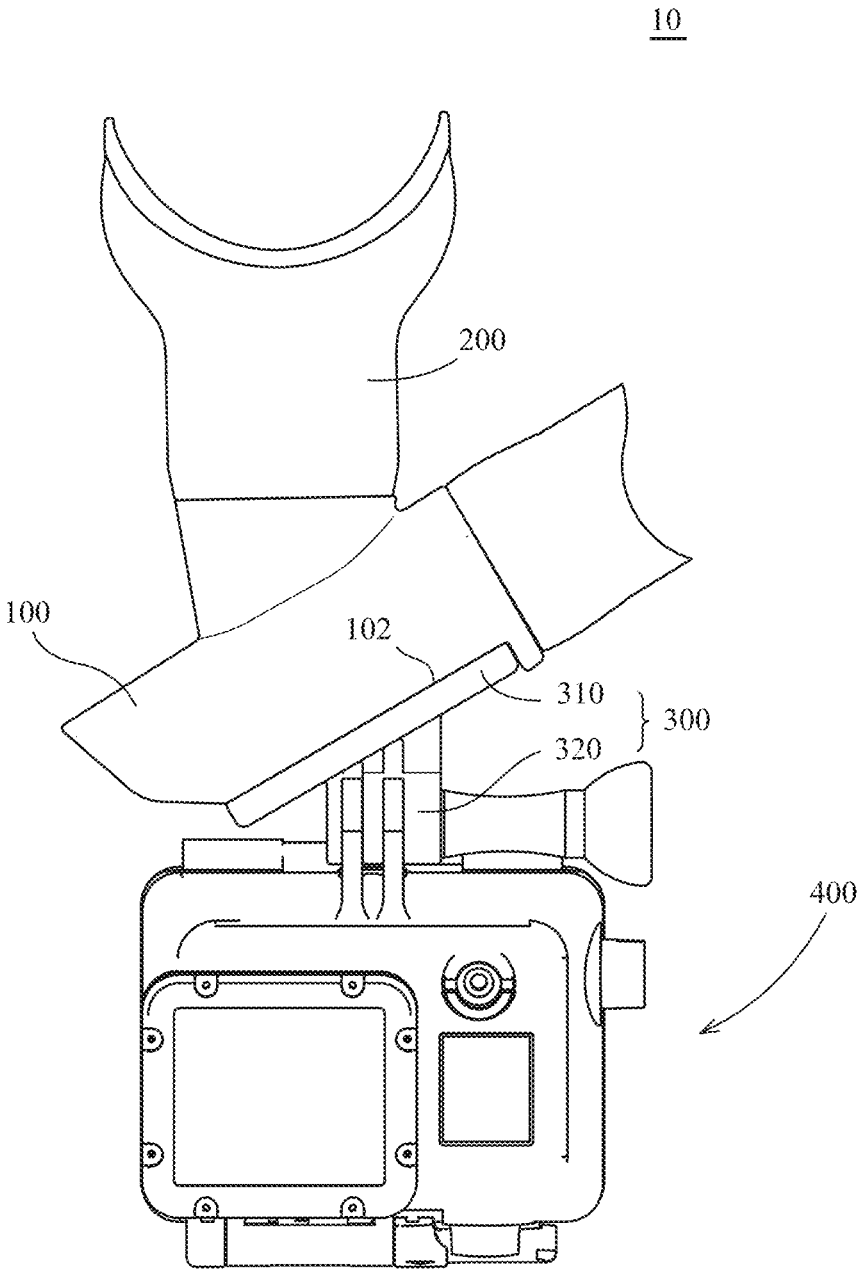
FIG. 1A and FIG. 1B are respectively a front view and a perspective exploded view of a snorkel mouthpiece assembly according to the preferred embodiment of the present invention.
Figure 1B:
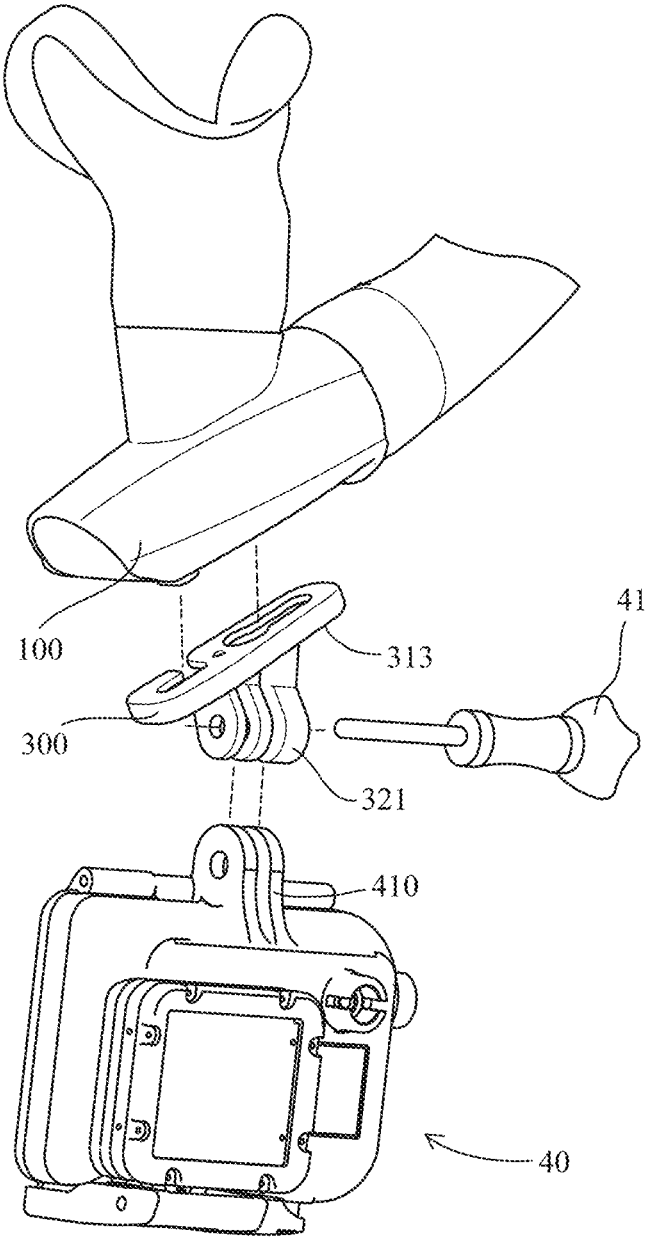

FIG. 1A and FIG. 1B show a snorkel mouthpiece assembly 10 according to the preferred embodiment of the present invention. The snorkel mouthpiece assembly 10 may be used in combination with a snorkel body and/or a mask (not shown) to allow the user to breathe air when the user is performing underwater or other water activities. The snorkel mouthpiece assembly 10 comprises a main body 100, a mouthpiece 200, a connecting component 300 and an accessory 400. The technical contents of each of the components are described in sequence as follows.

The main body 100 is a hollow structure and may be made of a soft or hard material. The mouthpiece 200 is connected to the main body 100 and is in gas communication with the inside of the main body 100. The mouthpiece 200 may be manufactured integrally with the main body 100. The mouthpiece 200 and the main body 100 may also be separately manufactured and then assembled with each other. The connecting component 300 has a connecting portion 310 and a fixing portion 320 opposite to the connecting portion 310. The connecting component 300 may be detachably connected with the main body 100 through the connecting portion 310. An accessory 400 is connected through the fixing portion 320, or is assembled to the fixing portion 320, so that the accessory 400 may be freely detached from/attached to the main body 100.

The main body 100 and the connecting component 300 may be connected through a sliding rail, mortise and tenon or adsorption (not shown). Preferably, the connection between the main body 100 and the connecting component 300 is convenient and quick for attachment and detachment.

Figure 2:
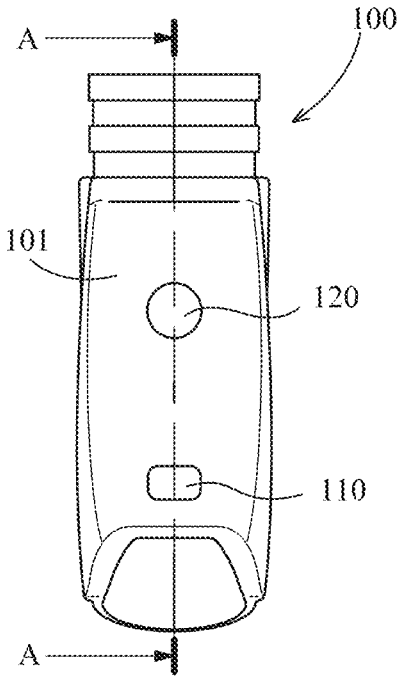
FIG. 2 is a side view of a mouthpiece of the snorkel mouthpiece assembly shown in FIG. 1A.
Figure 3:
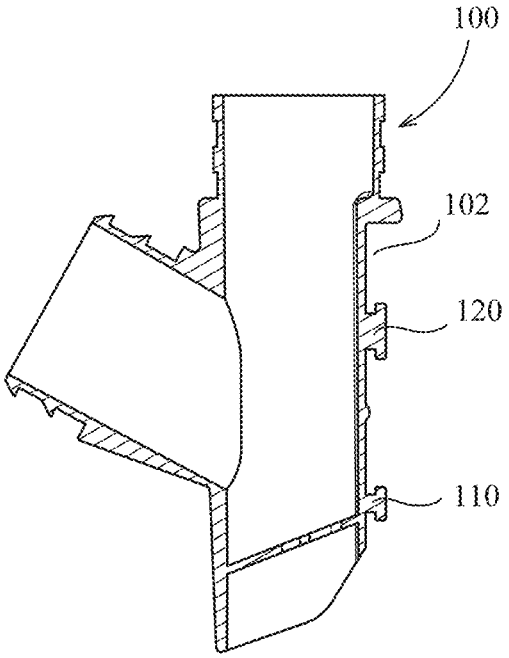
FIG. 3 is a cross-sectional view of the mouthpiece shown in FIG. 2 taken along line A-A.

In detail, with reference to both FIG. 2 and FIG. 3, the main body 100 may comprise a first bump 110 and a second bump 120, both of which are disposed on the outer edge surface 101 of the main body 100. Each of the first bump 110 and the second bump 120 may be a limiting bump or a circular bump. Both the first bump 110 and the second bump 120 may be of a shape (which may also be called a mushroom shape) where the thickness (the thickness of the material, which may also be regarded as the width) of an end near the outer edge surface 101 is smaller and the thickness of the other end away from the outer edge surface 101 is larger. The outer edge surface 101 of the main body 100 may be further provided with a containing groove 102 in which the first bump 110 and the second bump 120 may be disposed. The containing groove 102 may have a shape conforming to the connecting portion 310 of the connecting component 300 to contain the connecting portion 310. When the connecting component 300 is connected to the main body 100, the connecting portion 310 may be located in the containing groove 102 and abut against the outer edge surface 101 of the main body 100. The fixing portion 320 may partially or completely protrude outside the containing groove 102 to connect an accessory 400.

Figure 4:
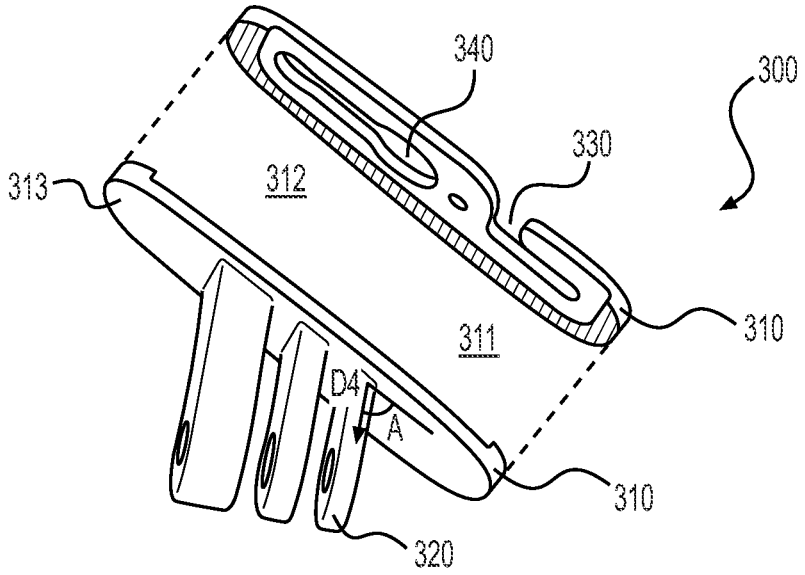
FIG. 4 is a perspective view after sectional cutting of the connecting component of the snorkel mouthpiece assembly shown in FIG. 1A.

With reference to FIG. 4, the connecting component 300 may be made of a soft or hard material so that the connecting component 300 will not fall off or be damaged due to the external impact or pulling (e.g., due to an external force greater than the force applied when operating the connecting component 300) after it is fixed. The connecting portion 310 comprises a first sliding slot 330 and a second sliding slot 340. The first bump 110 may pass through the first sliding slot 330 and slide in a space 311. The second bump 120 may pass through the second sliding slot 340 and slide and rotate in a space 312. The space 311 and the space 312 may be connected with or separated from each other.

Figure 5:
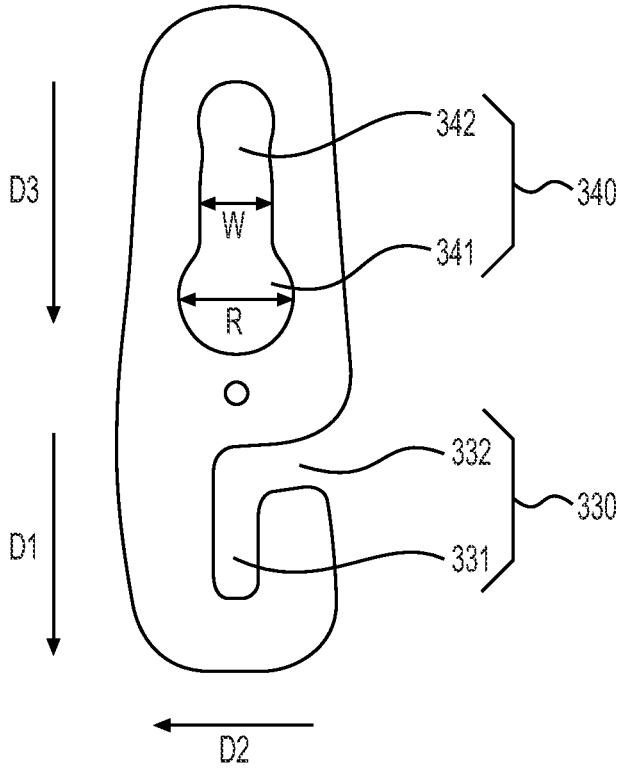
FIG. 5 is a side view of a connecting portion of the connecting component shown in FIG. 4.
Figures 6A, 6B, 6C, 6D, 6E:
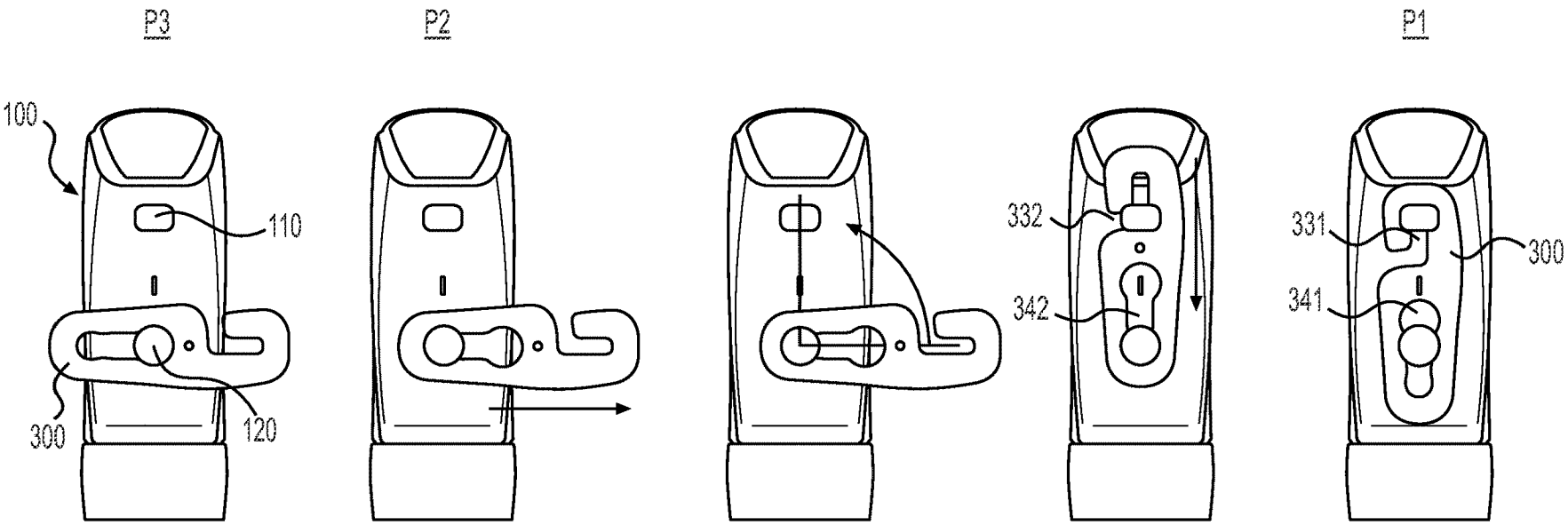
FIG. 6A to FIG. 6E are schematic views illustrating various states of the connection between the connecting component and the main body of the snorkel mouthpiece assembly shown in FIG. 1A.

With reference to FIG. 5, the first sliding slot 330 further comprises a first portion 331 and a second portion 332. An extending direction D1 of the first portion 331 is interleaved with an extending direction D2 of the second portion 332 so that the first portion 331 and the second portion 332 connect with each other after the extension. The second portion 332 may further extend to the outside of the connecting portion 310, i.e., the space 311 of the first sliding slot 330 may connect with the outside. An extending direction D3 of the second sliding slot 340 and the extending direction D1 of the first portion 331 are substantially parallel (possibly be slightly non-parallel due to manufacturing tolerances). The second sliding slot 340 further comprises an opening 341 and a passage 342 connected with each other. The opening 341 is disposed at an end near the first sliding slot 330 and has a diameter R larger than a width W of the passage 342. The space 312 of the second sliding slot 340 may or may not be connected to the outside.

When the second bump 120 is mushroom-shaped, the diameter R is larger than the thickness of the other end of the second bump 120 that is away from the outer edge surface 101. The fit between one end of the second bump 120 that is near the outer edge surface 101 and the passage 342 may be Clearance fits or Transition fits so that the second bump 120 may slide/rotate easily in the passage 342, but it is not limited thereto. Each of the second bump 120 and the passage 342 may also have a plurality of racks (not shown) so that the second bump 120 may not slide easily due to mutual interference between the racks at a specific position after rotating in the passage 342. The second bump may not rotate arbitrarily due to water flow, but the user may apply a larger force to separate the racks to rotate the second bump 120.

In this way, with reference to both FIG. 6A to FIG. 6E, the steps of operating the connecting component 300 and the main body 100 from the separated state to the clipped state may comprise the following: passing the second bump 120 through the opening 341 into the space 312 (which is referred to as the third position P3 hereinafter); pulling the connecting component 300 rightwards so that the second bump 120 slides leftwards in the space 312 along the extending direction D3 of the second sliding slot 340 to the other end opposite to the opening 341 (which is referred to as the second position P2 hereinafter); rotating the connecting component 300 counterclockwise so that the first bump 110 enters the space 311 from the outside of the connecting component 300 along the extending direction D2 of the second portion 332 and slides rightwards to the point where the second portion 332 connects with the first portion 331; pulling the connecting component 330 downwards so that the first bump 110 slides upward to the bottom (the position where the first bump 110 cannot be moved upwards any more) in the space 311 along the extending direction D1 of the first portion 331. At this point, the second bump 120 also slides upwards in the space 312 along the extending direction D3 of the second sliding slot 340. When the first bump 110 cannot move any more, the second bump 120 is located in the passage 342 and does not enter the opening 341 (which is referred to as the first position P1 hereinafter). Furthermore, the connecting component 300 may be detached only when it is located at the third position P3. When the connecting component 300 is located at the second position P2, it is not detachable but may rotate freely. When the connecting component 300 is located at the first position P1, the connecting component 300 cannot be detached and cannot be rotated, and it will not easily fall off from the main body 100.

It shall be noted that the above directions (e.g., upward, downward, leftward, rightward, counterclockwise, etc.) are relative orientations, which may be defined according to the use status of the snorkel mouthpiece assembly 10 and the connecting component 300. These directions may be changed due to the different arrangements of the first sliding slot 330 and the second sliding slot 340. These directions do not indicate or imply that the snorkel mouthpiece assembly 10 and the connecting component 300 need to be constructed or operated in a specific direction. These directions should not be understood as limitations to the present invention.

As shown in FIG. 1A to FIG. 1B, in the preferred embodiment, the accessory 400 is an underwater video camera 40. The underwater video camera 40 has a plurality of ribs 410. The fixing portion 320 may comprise a plurality of corresponding ribs 321. The ribs 321 extend outwards from the outer surface 313 of the connecting portion 310 and may be combined with the ribs 410 in a staggered manner so that a fixing member 41 (which may be a part of an underwater video camera purchased by the user) of the underwater video camera 40 may be used by the user for fixing. With reference back to FIG. 4, an angle A is included between the extending direction D4 of the ribs 321 and the outer surface 313. Angle A is not less than 30 degrees and not greater than 90 degrees. In this way, when the user bites the snorkel mouthpiece assembly 10 in the water after the connecting component 300 is fixed at the first position P1, the underwater video camera 40 faces the ideal direction, i.e., the shooting level of the underwater video camera 40 may be approximately parallel to the visual level of the user. The direction is the same as the direction that the user's head faces so that the shooting result is as seen by the user during the water activity, but it is not limited thereto. The user may also rotate the connecting component 300 to the second position P2 or other positions between the first position P1 and the second position P2 according to the requirements needed for photographing scenes in different directions.

Figure 7A:
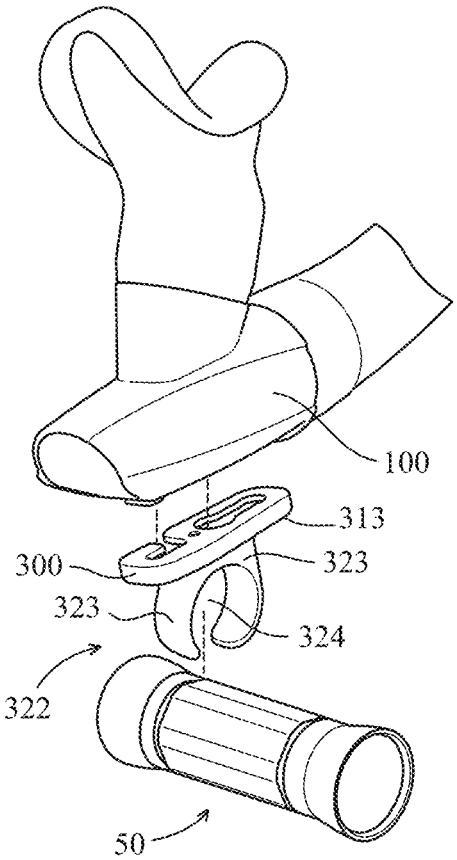
FIG. 7A and FIG. 7B are respectively a perspective exploded view and an assembled view of a snorkel mouthpiece assembly according to another preferred embodiment of the present invention.
Figure 7B:
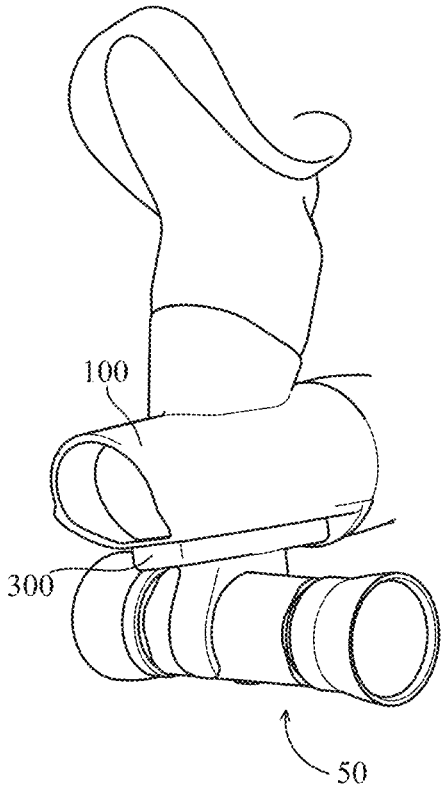

As shown in FIG. 7A to FIG. 7B, in another embodiment, the fixing portion 320 may comprise a clip component 322 when the accessory 400 is a flashlight 50. The clip component 322 extends outwards from the outer surface 313 of the connecting portion 310 and may be made of a hard material. The clip component 322 may comprise two clips 323 to jointly define a circular or polygonal clamping space 324. In this way, the flashlight 50 may be clamped between the two clips 323 to provide illumination in accordance with the advancing direction of the user in the water. The accessory 400 may also be devices used for other underwater activities, such as an LED light, a sound transmitter or the like (not shown).

According to the above descriptions, the snorkel mouthpiece assembly 10 of the present invention has a connecting component 300 which is detachably connected to the main body 100 and may be connected to an accessory 400, and thus, a user may directly attach the accessory 400 to the snorkel mouthpiece assembly 10 without the need of holding the accessory 400 with the hand thereof. The user may also directly replace the accessory 400 according to the underwater requirements without the need of purchasing other types of snorkels.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A snorkel mouthpiece assembly, comprising:

a main body;

a mouthpiece, connected to the main body;

a connecting component, comprising a connecting portion and a fixing portion opposite to the connecting portion, wherein the connecting portion is rotatably and detachably connected to the main body and able to be rotated from a first position to a second position, and wherein the fixing portion extends outward along an extending direction from an outer surface of the connecting potion, and an angle is included between the extending direction and the outer surface.

2. The snorkel mouthpiece assembly according to claim 1, wherein the main body further comprises a containing groove disposed on an outer edge surface, and when the connecting component is in the first position, the connecting portion is in the containing groove and abuts against the outer edge surface of the main body.

3. The snorkel mouthpiece assembly according to claim 1, wherein the fixing portion comprises a plurality of ribs in order to be ready to connect to an accessory.

4. The snorkel mouthpiece assembly according to claim 3, wherein the angle is not less than 30 degrees and not greater than 90 degrees.

5. The snorkel mouthpiece assembly according to claim 3, wherein the accessory is a photographing device.

6. The snorkel mouthpiece assembly according to claim 1, wherein the fixing portion is a clip component, in order to be ready to clip an accessory.

7. The snorkel mouthpiece assembly according to claim 6, wherein the accessory is a flashlight.

8. The snorkel mouthpiece assembly according to claim 1, wherein the main body further comprises a first bump and a second bump disposed on an outer edge surface of the main body, the connecting portion further comprises a first sliding slot and a second sliding slot, the first bump is slidably and detachably connected to the first sliding slot, and the second bump is rotatably and slidably connected to the second sliding slot;

wherein the first sliding slot comprises a first portion and a second portion which are connected, an extending direction of the first portion is interleaved with an extending direction of the second portion, and the extending direction of the first portion is substantially parallel to an extending direction of the second sliding slot.

9. The snorkel mouthpiece assembly according to claim 8, when the connecting component is in the first position, the first bump is in the first portion of the first sliding slot and the second bump is in the second sliding slot, and when the connecting component is rotated from the first position to the second position, the first bump is slid from the first portion to the second portion, and then leaves the second portion.

10. The snorkel mouthpiece assembly according to claim 8, wherein the second sliding slot comprises an opening and a passage which are connected, the opening is closer to the first sliding slot, and a diameter of the opening is larger than a width of the passage.

11. The snorkel mouthpiece assembly according to claim 10, wherein the connecting component is able to slide from the second position to a third position for leaving the main body, and when the connecting component is in the third position, the first bump is away from the connecting component and the second bump is in the opening.

* * * * *